166-250 SR
FIP8011 OR 4,116,274

United States Patent [19]

Rankin et al.

[11] 4,116,274

[45] Sep. 26, 1978

[54] WIRELINE LATCHING APPARATUS AND METHOD OF USE

[75] Inventors: E. Edward Rankin, Aberdeen, Scotland; David W. King, Fort Worth, Tex.

[73] Assignee: Petro-Data C.A., Dallas, Tex.

[21] Appl. No.: 818,424

[22] Filed: Jul. 25, 1977

[51] Int. Cl.[2] ..... E21B 47/06; E21B 23/02

[52] U.S. Cl. ..... 166/250; 166/65 R; 166/206

[58] Field of Search ..... 166/250, 206, 214, 215, 166/216, 65 R, 65 M

[56] References Cited

U.S. PATENT DOCUMENTS

| | | | |
|---|---|---|---|
| 3,064,737 | 11/1962 | Quinn | 166/214 |
| 3,104,714 | 9/1963 | Terrel et al. | 166/206 |
| 3,163,228 | 12/1964 | Hayes | 166/214 |
| 3,381,751 | 5/1968 | McLelland | 166/65 R |

*Primary Examiner*—Ernest R. Purser
*Attorney, Agent, or Firm*—Wofford, Felsman, Fails & Zobal

[57] ABSTRACT

A wireline latching apparatus and method of use with wireline instruments for measuring temperature and pressure downhole in flowing oil and gas wells. The latching apparatus includes a tubular body for connection to the instrument. Three arms are mounted in the tubular body pivotally so that their upper ends open outward. A downwardly facing shoulder is located in the well pipe in the area where the measurements are to be taken. An actuating mechanism is operable to open and close the arms so that their upper ends bear against the shoulder. The instrument with the latching mechanism is lowered into the well and positioned so that the arms are adjacent the shoulder. The arms are opened to engage the shoulder and the wireline tensioned to prevent whipping of the line as fluid flows past.

8 Claims, 3 Drawing Figures

WIRELINE LATCHING APPARATUS AND METHOD OF USE

BACKGROUND OF THE INVENTION

1. Field of the Invention

This invention relates in general to wireline instruments for measuring temperature and pressure in oil and gas wells and in particular to a latching mechanism for use with such instruments to prevent upward movement of the instrument in flowing oil and gas wells.

2. Description of the Prior Art

Pressure and temperature measurements are commonly taken downhole in flowing oil and gas wells in order to determine reservoir conditions. A typical manner in which the measurements are taken is by lowering temperature and pressure instruments into the well to a depth slightly abovethe zone desired to be measured. Conductor cable is frequently used to lower the instruments into the well so that a concurrent surface indication is displayed at the surface.

Since a flowing well is under pressure, a sealing apparatus is placed on top of the christmas tree of the type that seals against the internal pressure but allows the line to move. Normally the flow from the well is shut off at the surface while the instrument is being lowered. Because of the pressure, there is a tendency for the cable to be pushed out of the sealing apparatus, thus lead weights are attached to the instrument to cause it to sink. The well is allowed to flow once the tool is at the desired place. In very high flow rate wells, the fluid flow may cause the instrument to move upward, even though sufficient weights were used to lower the instrument into the well. This can cause the cable to knot and kink, making it difficult to retrieve the instrument through the sealing apparatus.

SUMMARY OF THE INVENTION

It is accordingly a general object of this invention to provide an improved apparatus that prevents upward movement of a wireline instrument while measuring conditions in flowing oil and gas wells.

It is a further object of this invention to provide an improved method of preventing upward movement of a wireline instrument while measuring temperature and pressure in flowing oil and gas wells.

In accordance with these objects, a latching apparatus is provided for connection to the temperature and pressure sensing instrument. The latching apparatus has a tubular body with arms pivotally mounted to it from their lower ends. An electrically driven actuating mechanism selectively moves the arms from a closed position flush with the tool body to an open position with their upper ends protruding upward and outward. Landing means is located or placed in the well tubing at the depth where measurements are desired to be taken. The landing means has a downwardly facing shoulder that is engaged by the upper ends of the arms to prevent upward movement of the instrument. The line is preferably tensioned after the arms are opened to prevent whipping of the line by the fluid flow.

DESCRIPTION OF THE PREFERRED EMBODIMENT

Figure 1:
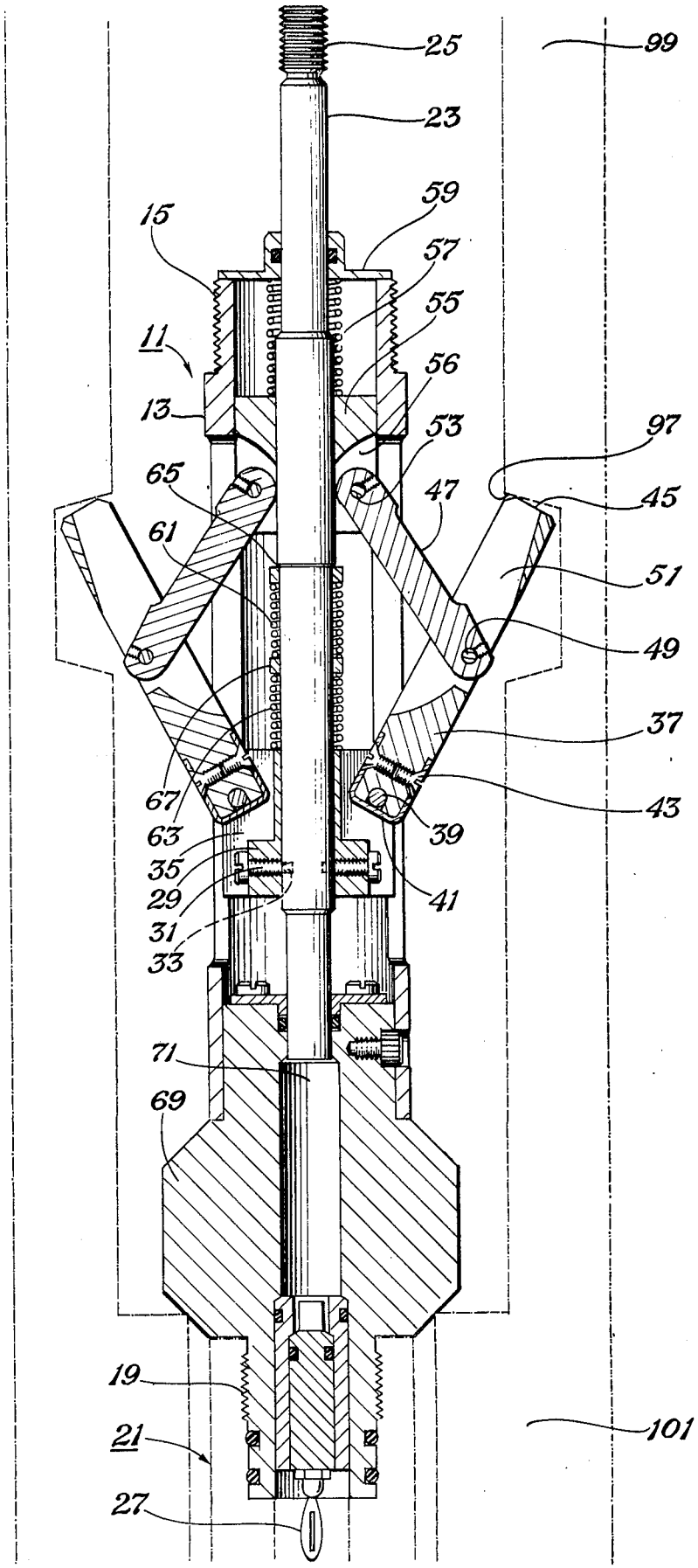
FIG. 1 is a 120° vertical sectional view of a latching apparatus constructed in accordance with this invention.

Referring to FIG. 1, a latching apparatus 11 is shown in open position. The latching apparatus 11 has a tubular body 13 with the upper end 15 threaded for connection to the electrical actuator 17, shown in FIG. 2. The lower end 19 is threaded for connection to the temperature and pressure instruments, designated in phantom as numeral 21.

A hollow shaft 23 extends axially through the tubular body 13, protruding from the upper end and having threads 25 for engagement with the electrical actuator 17. An electrical wire (not shown) extends through shaft 23 and terminates at a pin 27 at the lower end of the latching apparatus. Pin 27 mates in a receptacle (not shown) in instrument 21 for supplying power and transmitting signals from the temperature and pressure measuring instruments 21.

A first mounting member or arm carrier 29 has a central bore for receiving shaft 23 and is rigidly connected to shaft 23 by three shear screws 31. Shear screws 31 have a reduced portion 33 on the end threaded into shaft 23 that is sized to shear at a predetermined tension for the fail safe mechanism, explained hereinafter. Arm carrier 29 has three vertical slots 35 spaced 120° apart. The lower end of an arm 37 is pivotally mounted within each slot 35 by a pin 39, U-shaped bracket 41 and retaining screws 43. Removal of bracket 41 by screws 39 allows the arm 37 to be lifted upward from pin 41. The upper end 45 of arm 37 is free to move from an open position protruding upwardly and outwardly, as in FIG. 1, to a closed position, flush with the tubular body 13, as in FIG. 3.

Figure 3:
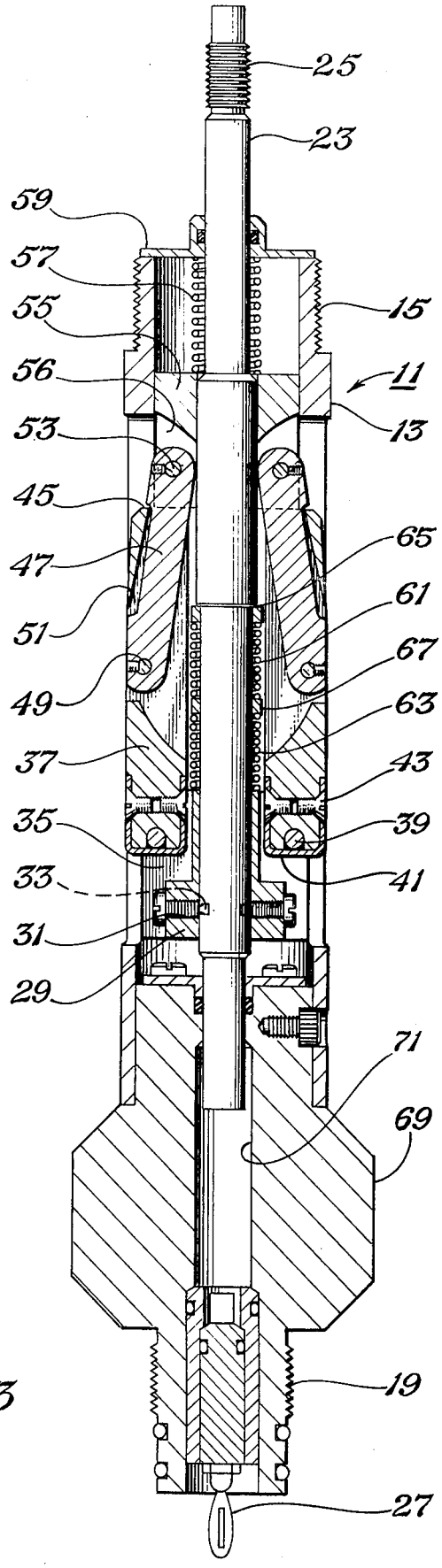
FIG. 3 is a 120° vertical sectional view of the latching apparatus of FIG. 1 with the arms in the closed position.

A link 47 is pivotally mounted by pin 49 to each arm 37 intermediate its ends approximately at the center. Arm 37 has a recessed area 51 formed in it to allow the link 47 and arm 37 to close, as shown in FIG. 3. The upper end of each link 47 is pivotally mounted by pin 53 to a second mounting member or link carrier 55.

Link carrier 55 is, like arm carrier 29, a cylindrical element having an axial bore for receiving shaft 23 and having three vertical slots 56 spaced 120° apart. A link 47 is inserted into each slot 56. Link carrier 55, however, is independently movable of shaft 23, being free to slide axially. A coil spring 57 is received over shaft 23 above the link carrier 55. A washer 59 is fitted over spring 57, to prevent upward movement of spring 57. An internal shoulder (not shown) in tubular body 15 prevents downward movement of link carrier 55 toward arm carrier 29, while spring 57 biases against upward movement.

Second and third coil springs 61 and 63 are received over shaft 23 between the upper side of the arm carrier 29 and a shoulder 65 on the shaft 23. A washer 67 separates the two springs 61, 63 and is movable independently of shaft 23. The two springs 61, 63 function as a single spring and are retained in position under compression.

Three fins 69 spaced 120° apart are attached to the lower end of the tubular body 13. Fins 69 are larger in diameter than the tubular body 13 and have an axial passage 71 for receiving shaft 23 and the electrical wire (not shown).

Figure 2:
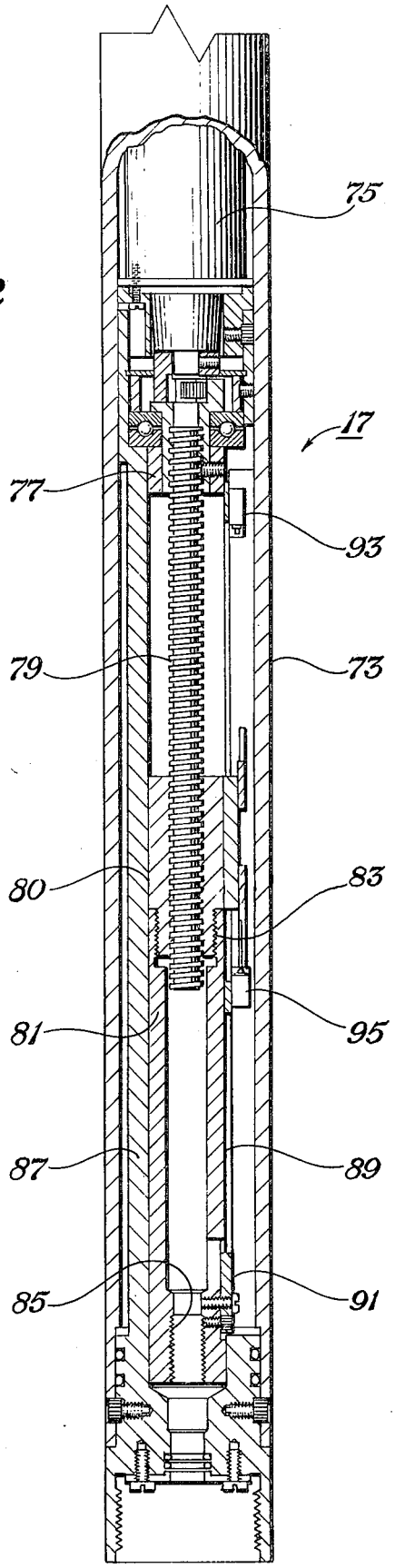
FIG. 2 is a vertical sectional view of the motorized section of the actuating mechanism for the latching apparatus of FIG. 1.

Referring to FIG. 2, the electrical actuator means includes a tubular housing 73 within which an electrical motor 75 is rigidly attached. The electrical motor 75 is controlled from the surface and its output mechanism 77 is rigidly attached to a threaded rod or screw 79. The lower end of screw 79 is threaded into a threaded sleeve 80 that is reciprocable in tubular housing 73. A rotary to linear translator or shaft carrier 81 comprises a tubular member with threads 83 on the upper end for connection to sleeve 80 and threads 85 on the lower end for receiving the threaded end 25 of shaft 23. The bore of shaft carrier 81 is carried vertically, or axially movable in a subhousing 87, but is prevented from rotation by a slot 89 in subhousing 87 and key 91. Limit switches 93, 95 switch the motor 75 off when the shaft carrier 81 is at its uppermost and lowermost positions.

The latching apparatus 11 is adapted for use with landing means located in the well. The landing means includes a downwardly facing shoulder indicated as 97 in FIG. 1, that should be placed in the string of tubing, indicated as 99 in FIG. 1. Preferably a member with a reduced diameter portion 101, known as a "nogo," is located below the shoulder a distance equal to the distance between the fins 69 and upper ends 45 of arms 37. Nogo 101 should be smaller in diameter than fins 69, but larger than the diameter of the instrument 21. Also passages should be provided in the nogo to facilitate flow of the fluid. The landing means may be placed at the desired depth during a time when the tubing 99 is out of the well and will remain in place during normal production.

In operation, the flow from the well is closed off at the top and wireline sealing means installed on the christmas tree. The wireline sealing means is of a type that seals on moving single conductor cable of approximately 3/16 inch diameter. The cable is of the type that contains the conductor wire in the center and is surrounded by a plurality of twisted wires or armour that protect the conductor from damage and add strength. The sealing means may utilize grease pumped around the cable in close fitting tubes to contain the pressure.

The latching apparatus 11 is threaded into the electrical actuator 17, simultaneously connecting shaft 23 to the shaft carrier 81. The arms 37 should be closed at this time. The temperature and pressure instruments 21 are connected to the lower end 19 of the latching apparatus 11. Lead weights to aid in running the tool in, and a collar locator for depth control, may also be connected into the assembly.

The assembly is connected to the cable and lowered into the well while under pressure, but normally not while flowing, until the fins strike the nogo 101. The motor 75 is then energized to rotate screw 79, drawing shaft carrier 81 upward and along with it shaft 23 and arm carrier 29. Since the link carrier 55 is substantially stationary, arms 37 are forced outward, engaging shoulder 97. Springs 61, 63 will be unaffected by this movement, since they are compressed between fixed points on a shaft 23. Coil spring 57 will compress to some extent as the arm 37 and link 47 tend to force the link carrier 55 upward.

The motor 75 is then stopped and the cable drawn upward to a selected tension. Force of the cable will be transmitted through the shaft 23 to the arms 37, drawing them tightly against shoulder 97. This prevents undesirable whipping of the line by the fluid flow. The valves at the surface are then turned on to allow the fluid to flow past the instrument and latching apparatus 11. The instruments are energized by surface control equipment to give a concurrent surface reading of temperature and pressure.

Once the measurements are completed, the fluid flow is closed at the surface, tension is relieved, and the motor is energized to push shaft downward. This draws in arms 37 flush with the tool body 13, as shown in FIG. 3. The combined latching apparatus and instruments may then be retrieved from the well.

Should the actuating means fail to close the arms because of a malfunction, fail-safe means can be employed to close the arms by the use of cable tension. The cable is tensioned until the shear screws 31 shear from their ends 33, this force being calculated to be at a safe value below the cable strength. The tension is then released. This allows springs 61 and 63 to return to the natural state, drawing down with them arm carrier 29, thus closing arms 37. The latching apparatus can then be retrieved from the well.

The latching apparatus is suitable for use without the nogo 101, using simply some type of ledge or shoulder located in the tubing to serve as landing means for the arms to latch against. In this case, since the precise depth of the shoulder may not be known, the arms 37 are opened below where a shoulder is expected, with their ends bearing against the inner wall of the tubing. The latching apparatus is then pulled upward. When the upper ends of the arms come in contact with a recessed shoulder, they will spring further out into the recess due to the compression of spring 57. Upward movement is then stopped and measurements taken.

It should be apparent that an invention having significant improvements has been provided. The latching apparatus and method of use provide positive retention of the instrument, preventing upward movement of the tool due to fluid flow. Whipping and kinking of the line is avoided.

While the invention has been shown in only one of its forms, it should be apparent to those skilled in the art that it is not so limited but is susceptible to various changes and modifications without departing from the spirit thereof.

We claim:

1. An apparatus for preventing a wireline instrument from moving upward in pipe while measuring fluid flow conditions in oil and gas wells comprising:

a tubular body connected to the instrument;

an arm pivotally carried at its lower end by the tubular body, the upper end of the arm being movable between a closed position and an open position to engage the underside of a shoulder in the pipe, the arm being structured so as to allow fluid to flow past while in the open position; and actuating means for moving the arm between the open and closed positions; the actuating means being electrically powered;

the actuating means and arm interconnected so that tension in the line may be transmitted though the arm to draw it tightly against the shoulder, thereby preventing upward movement of the instrument and whipping of the wireline due to flowing fluid.

2. An apparatus for preventing a wireline instrument from moving upward in pipe while measuring fluid flow conditions in oil and gas wells comprising:

a tubular body connected to the instrument;

an arm pivotally carried at its lower end by the tubular body, the upper end of the arm being movable between a closed position and an open position to engage the underside of a shoulder in the pipe, the arm being structured so as to allow fluid to flow past while in the open position; and actuating means for moving the arm between the open and closed positions;

the actuating means and arm interconnected so that tension in the line may be transmitted though the arm to draw it tightly against the shoulder, thereby preventing upward movement of the instrument and whipping of the wireline due to flowing fluid;

the actuating means comprising:

a housing connected to the tubular body;

an electrical motor mounted rigidly in the housing;

a screw connected to the output shaft of the electrical motor for rotation therewith;

a tubular member carried slidably in the housing and having one end connected to the screw, the tubular member being restrained from rotation so that rotation of the screw causes axial movement of the tubular member;

a shaft extending from the tubular body into the housing and connected to the end of the tubular member that is opposite the screw, for vertical movement therewith;

a first mounting member encircling and connected to the shaft within the tubular body for vertical movement with the shaft, the arm being pivotally mounted to the mounting member;

a second mounting member slidably encircling the shaft within the tubular body above the first mounting member for independent movement with respect to the shaft;

a first spring encircling the shaft between the second mounting member and the housing to bias against upward movement of the second mounting member; and a link having its lower end pivotally mounted to the arm intermediate the ends of the arm, and its upper end pivotally mounted to the second mounting member;

whereby upward axial movement of the shaft causes the lower end of the arm to move vertically downward to force the upper end of the arm outward, and downward axial movement of the shaft causes the lower end of the arm to move vertically downward, drawing the upper end of the arm inward.

3. The apparatus according to claim 2 wherein the apparatus further includes fail-safe means for closing the arm by wireline tension should the actuating means fail to function.

4. The apparatus according to claim 3 wherein the fail-safe means comprises:

a second spring encircling the shaft and compressed between the first mounting member and a protrusion on the shaft above the first mounting member;

a shear pin forming the connection between the first mounting member and the shaft, capable of breaking should the wireline tension exceed a predetermined level, thereby causing the second spring to return to its unbiased condition and moving first mounting member downward with respect to the shaft to close the arm.

5. In combination with a wireline instrument of the type having means for sensing temperature and pressure downhole in oil and gas wells and transmitting signals to the surface through conductor cable for concurrent surface indication, means for preventing the instrument from moving upward due to the fluid flow, comprising:

a tubular body connected to the wireline instrument;

a plurality of arms, each pivotally carried at its lower end by the tubular body, the upper end of each arm being movable between a closed position fluid with the tubular body and an open position protruding upward and outward;

landing means, located in the well at the depth where measurements are to be taken, having a downwardly facing shoulder for engagement with the upper ends of the arms when in open position; and actuating means for moving the arms between the open and closed positions, the actuating means allowing tension in the cable to be transmitted to the arms to draw them tightly against the shoulder, preventing upward movement of the instrument and whipping of the line as the fluid flows past; the actuating means including an electrical motor and linkage means connected between the motor and the arms for selectively causing the motor to move the arms outward and inward when the motor is rotated.

6. In combination with a wireline instrument of the type having means for sensing temperature and pressure downhole in oil and gas wells and transmitting signals to the surface through conductor cable for concurrent surface indication, means for preventing the instrument from moving upward due to the fluid flow, comprising:

a tubular body connected to the wireline instrument;

a plurality of arms, each pivotally carried at its lower end by the tubular body, the upper end of each arm being movable between a closed position flush with the tubular body and an open position protruding upward and outward;

landing means, located in the well at the depth where measurements are to be taken, having a downwardly facing shoulder for engagement with the upper ends of the arms when in open position; and actuating means for moving the arms between the open and closed positions, the actuating means allowing tension in the cable to be transmitted to the arms to draw them tightly against the shoulder, preventing upward movement of the instrument and whipping of the line as the fluid flows past;

a plurality of fins connected to the lower end of the tubular body; and a reduced portion formed in the landing means that is smaller in diameter than the fins, but larger in diameter than the instrument, the reduced portion being located below the shoulder at a distance equal to the distance from the fins to the upper ends of the arms to align the upper ends of the arms with the shoulder when the fins are seated on the reduced portion.

7. A method of measuring fluid temperature and pressure downhole in flowing oil and gas wells with an instrument lowered into the well on conductor cable, comprising:

placing a landing means having a downwardly facing shoulder in the well substantially at the depth where measurements are desired;

connecting a latching member to the instrument, the latching member having a plurality of arms whose upper ends selectively pivot between a closed position flush with the latching member and an open position protruding upward and outward; the latching member further having actuating means that includes an electrical motor for selectively opening and closing the arms when the motor is energized;

lowering the instrument into the well with the arms in the closed position and positioning the instrument so that the upper arms are below the shoulder;

then opening the arms by energizing the motor and tensioning the cable so that the upper ends of the arms bear against the shoulder to prevent upward movement;

then sensing the temperature and pressure as the fluid flows around the instrument, concurrently receiving an indication at the surface; and closing the arms by energizing the motor after measuring is completed and then removing the instrument from the well.

8. The method according to claim 7 further comprising the step of:

applying tension in the cable while the arms are bearing against the shoulder to prevent whipping of the line by the flowing fluid.

* * * * *